United States Patent [19]

Pfaffmann et al.

[11] Patent Number: 4,592,537

[45] Date of Patent: Jun. 3, 1986

[54] APPARATUS FOR HEAT TREATING AND SIZING THIN WALLED ARTICLES

[75] Inventors: George D. Pfaffmann, Farmington, Mich.; Paul L. Day, Parma, Ohio

[73] Assignee: Tocco, Inc., Boaz, Ala.

[21] Appl. No.: 689,454

[22] Filed: Jan. 7, 1985

[51] Int. Cl.[4] ..... C21D 11/00

[52] U.S. Cl. ..... 266/78; 266/90; 266/115; 266/117; 266/123; 266/129

[58] Field of Search ..... 266/78, 89, 90, 91, 266/123, 115, 117–119, 129, 125; 148/128

[56] References Cited

U.S. PATENT DOCUMENTS

| | | | |
|---|---|---|---|
| 3,834,013 | 10/1974 | Gerstle | 29/596 |
| 4,030,963 | 9/1977 | Kunioka et al. | 148/128 |
| 4,147,569 | 4/1979 | Reinke et al. | 148/128 |
| 4,401,485 | 8/1983 | Novorsky | 148/146 |

FOREIGN PATENT DOCUMENTS

| | | | |
|---|---|---|---|
| 412258 | 5/1974 | U.S.S.R. | 148/128 |
| 464625 | 7/1975 | U.S.S.R. | 148/128 |

*Primary Examiner*—Christopher W. Brody

*Attorney, Agent, or Firm*—Body, Vickers & Daniels

[57] ABSTRACT

Thin walled broached parts are heat treated from manufactured dimensions to predetermined dimensions through control of heating, cooling and pressurization parameters during the heat treating cycle.

6 Claims, 7 Drawing Figures

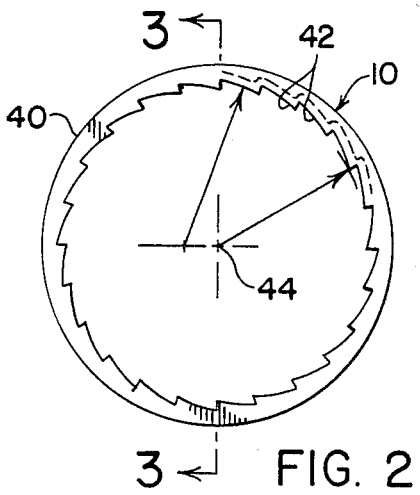
FIG. 2
FIG. 3
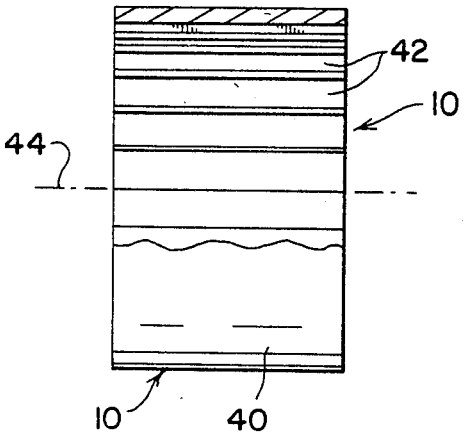
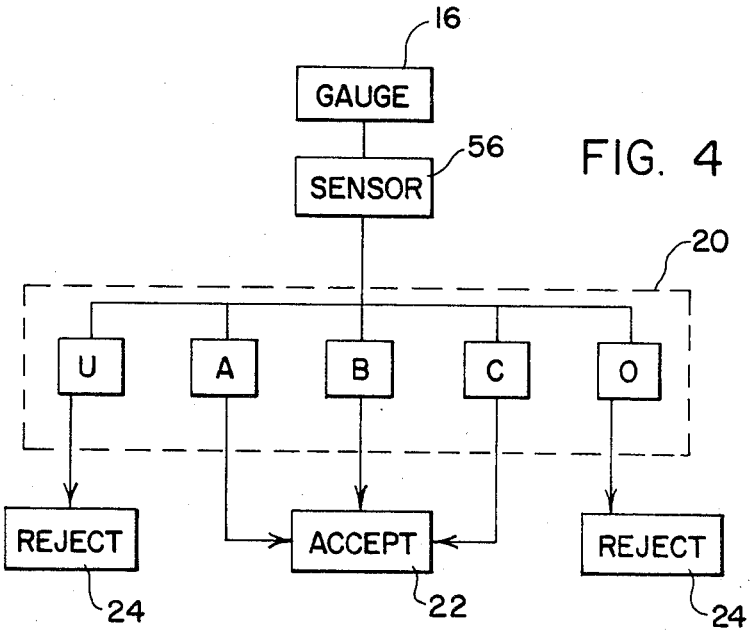
FIG. 4

APPARATUS FOR HEAT TREATING AND SIZING THIN WALLED ARTICLES

BACKGROUND

The present invention relates to the art of heat treating, and in particular, to a method and apparatus for sizing thin walled parts during a heat treating cycle.

The present invention is particularly applicable to altering irregular internal surfaces of thin walled parts formed by broaching and will be described with reference thereto; however, it will be hereinafter apparent that the invention has much broader aspects and may be beneficially used to control exterior surfaces and lengths as well, in parts formed by other machining operations such as turning, milling, shaping, boring and the like.

Broaching is widely employed in forming irregularly shaped surfaces where high production rates, close tolerances and smooth surfaces are required. The complete machining of the part can be performed accurately in a single pass of the broaching tool. This results in less expensive and faster production of parts than can be obtained by other conventional multi-step operations. For many complex shapes such as articles having internal cam surfaces, broaching is the only practical method for achieving the required accuracy in shape and size. During the broaching stroke, all of the cutting edges of the broach are cutting at once resulting in large tool forces, as severe as encountered in any other type of machining operation. Accordingly, the cutting teeth may break or wear, requiring frequent replacement or resharpening. As a consequence, subsequently produced parts may vary dimensionally with respect to previously produced parts and/or parts produced in parallel production lines. The broached parts may therefore have a range of dimensional sizes, some of which may be outside the product specification, and accordingly unacceptable, and others spanning an acceptable dimensional range.

In thin-wall, overrunning clutch cams in particular, in addition to requiring accurate control of the cam surfaces, the surfaces also must be heat treated for extended wear properties. By virtue of the metallurgical changes during the heat treating cycle, parts which, as machined, were within acceptable specifications may not be acceptable following the heat treating cycle. Inasmuch as further machining operations are impractical on the heat treated parts, further constraints are placed on the accuracy to which these parts must be broached to ensure that the post heat treated parts will have acceptable dimensions.

BRIEF SUMMARY OF THE INVENTION

The present invention provides a method and apparatus for maximizing the acceptable heat treated parts by controlled alteration of the heat treating cycle. Herein, the parts after the broaching operation are gauged and classified according to machined size. The classified parts comprise dimensional ranges which are within the capability of the heat treating apparatus to harden while effecting a controlled alteration of the broached configuration. These parts are placed in acceptable categories. Other classes will span ranges of dimensions outside the capabilities of the heat treat cycle to effect a dimensional alteration while providing the necessary hardness. These parts are placed in the rejected categories. The acceptable parts are classified into a limited number of dimensional classes. These acceptable parts may be placed in magazines for automatic loading at heat treating stations, or may be manually fed to the heat treating station. For each class, a heat treat cycle is prescribed which, through controlled pressure, heating and quenching, will provide a post heat treated size within acceptable limits, at the hardness required by the product specification. By regulation of the external pressure applied to the part, the effects of thermal expansion and contraction, and crystalline growth during the heating cycle are geometrically controlled, thus contributing to a selected increase or decrease in the internal size. At the same time, the heating rate can be regulated to control the depth of hardening and the amount of transformation into austenite. This will affect the amount of inward expansion due to crystalline growth and provide the control on post-heated configuration under the influence of the exterior pressure. Similarly, the cooling rate will determine the amount of transformation of the austenite into martensite and other products and consequently the dimensional variations as a result thereof, in combination with the heating cycle and the external pressure regulations. These parameters may be empirically determined for each part, and through microprocessors or mechanical coding used to alter the heat treating cycle in accordance with the classification of the presented parts. As a result of these combined techniques, parts which heretofore would have been rejected can now be heat treated to within size and hardness specifications.

Accordingly, it is an object of the present invention to provide a method and apparatus which selectively controls the heat treating parameters to effect sizing of the heat treated parts.

Another object of the present invention is to provide a method and apparatus for maximizing the number of heat treated parts within hardness and dimensional specifications.

A further object of the present invention is to maximize acceptable heat treated parts by classifying the parts after a machining operation into a limited number of parts classification, and varying parameters of the heating cycle, the cooling cycle and applied pressure to provide a post heat treated hardness and configuration within product specifications.

Still another object of the present invention is the provision of an apparatus for heat treating and sizing thin walled articles including means for classifying the articles into plurality of categories, heat treating means for heating, quenching and pressurizing the articles, and means responsive to the means for classifying interactive with the heat treating means for selectively varying the heating, quenching and pressurizing of the article during the heat treating cycle in a manner effective to alter select dimensions of the articles to within predetermined limits.

Still a further object of the present invention is to provide a process for heat treating to a predetermined internal dimension thin walled articles having a manufactured internal dimension by measuring the manufactured internal dimension of the articles, classifying the articles into a plurality of dimensional categories based on the measuring, accepting articles in the categories suitable for the heat treating process and for rejecting articles in categories not suitable for the process, establishing heat treating process parameters for each category sufficient to heat treat the article from the manufactured internal dimension to the predetermined internal dimension by controlledly heating, quenching and pressurizing the article during the heating and cooling cycles, and heat treating the articles under these process parameters to provide heat treated articles having the predetermined internal dimension.

These and other objects and advantages become apparent from the following description taken together with the drawings accompanying the disclosure.

BRIEF DESCRIPTION OF THE DRAWINGS

In this disclosure, the following drawings are incorporated:

FIG. 2 is a top view of a broached part to be processed in accordance with the present invention;

FIG. 3 is a sectional view taken along line 3—3 of FIG. 2;

FIG. 4 is a control diagram for the classifying station of the preferred embodiment;

DETAILED DESCRIPTION OF THE PREFERRED EMBODIMENT

Figure 1:
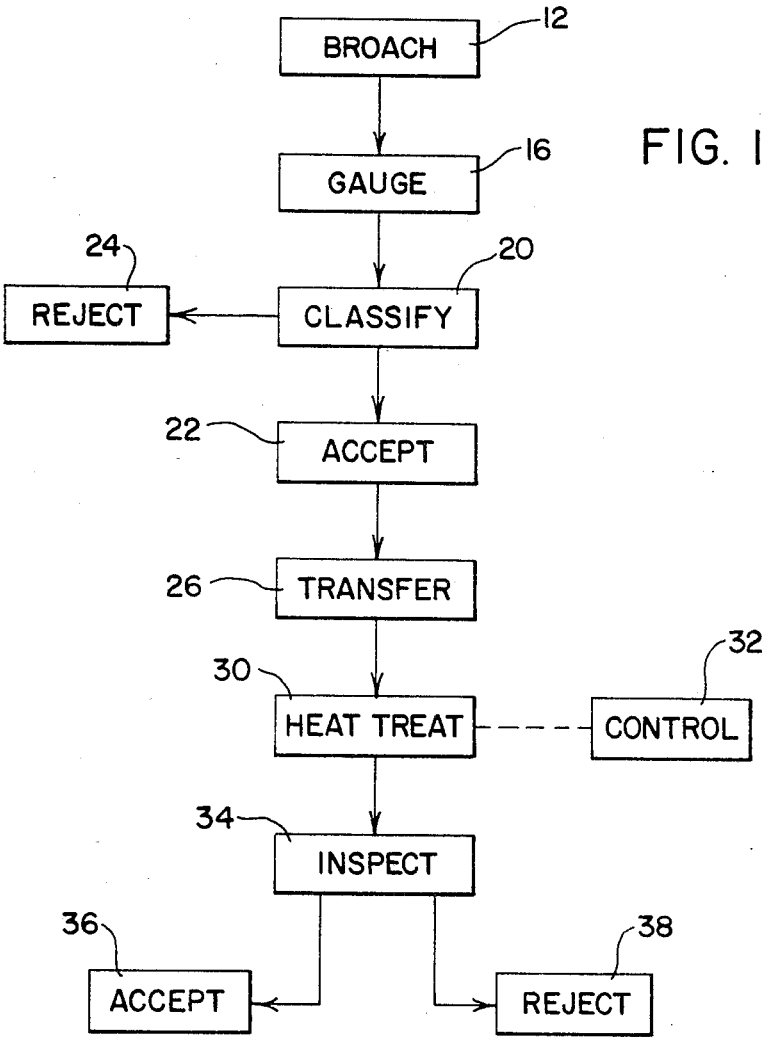
FIG. 1 is a process flow diagram schematically illustrating the preferred embodiment of the present invention.

Referring now to the drawings wherein the showings are for the purpose of illustrating the preferred embodiment of the invention only and not for the purpose of limiting same, FIG. 1 shows a process flow diagram wherein a part, such as an overrunning clutch cam race 10 shown in FIGS. 2 ahd 3 is broached to configuration at a broaching station 12, gauged or sized at a gauging station 16, classified at a classifying station 20 into acceptable categories 22 or reject categories 24, the acceptable categories being routed by a transfer operation 26 to a heat treating station 30 whereat the heat treating cycle is controlled by a control unit 32 for processing the clutch 10 in a controlled heat treating cycle to produce parts by a tailored parameter control to a final specification. The heat treated parts are thereafter inspected at an inspection station 34 and routed to an acceptance station 36 for shipment assembly or processing or to a rejection station 38 for scrap or non-standard uses.

Referring to FIGS. 2 and 3, the part 10 comprises a thin walled generally cylindrical article of alloy steel having a circular outer diameter 40 and an inner surface defined by a circumferential series of arcuate cams 42 generated on an arc offset from the article axis 44. In a well known manner, rollers retained between an inner hub, not shown, and the cams 42 are effective to accommodate relative rotation or slippage in one direction. In the other direction, the rollers ride up the cams 42 locking the hub to the part 10 and thereby transmitting torque therebetween. In such an application, tight dimensional control of the surfaces of the cams is critical to effective operation, in order to assure that slipping and driving conditions are uniformly obtained. In addition, because of the service conditions, the surfaces must be heat treated for strength and wear properties. Typically, control of the outer diameter and the cam surfaces must be maintained within 0.006 or less and heat treated around 59 to 63 Rockwell C.

The part 10, after preliminary machining is transferred to the broaching station 12. Thereat, a number of axially aligned roughly machined cylinders will have the inner cam surface formed in a single broaching stroke. Additionally, parallel lines may be used for like parts depending upon production requirements. Within these various broaching operations, an expected distribution of parts versus specification will be experienced, notwithstanding the generally accurate inherent operation of the broach. Following the broaching operation, the parts are transferred, manually or automatically, to the gauging station 16.

Figure 5:
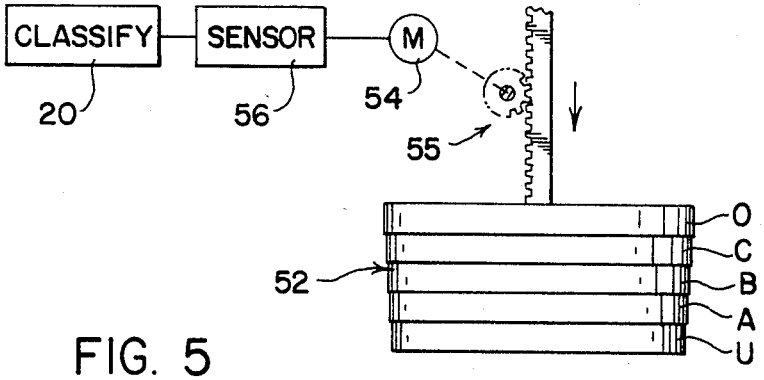
FIG. 5 is a partially sectioned view of the broached part at the gauging station together with a schematic diagram of the control systems therefor.

Referring to FIG. 5 at the gauging station 16, the part 10 is positioned within a gauging fixture 50. A gauge plug 52 mounted on the gauging station framework, not shown, is reciprocated upwardly and downwardly by means of an electrical motor 54 operatively connected with a rack and pinion drive 55. The gauge plug 52 has axially spaced bands of varying diameters. For purposes of illustration, the subject gauge plug 52 is a stepped design divided into five bands or classes. Unacceptably undersigned profiles are determined by the U band, acceptable profiles are determined by the progressively diametrically increasing bands A, B and C. Unacceptably undersized profiles are determined by the largest diameter or O band. In a well known manner, the gauge band entrance is determined by a sensor 56. Referring to FIG. 4, the sensor 56 is operative by means of display and manual transfer by automatic transferring equipment to classify the gauged parts into the reject category 24 or the appropriate acceptable category 22. It will be appreciated that the gauging station 16 may take any acceptable gauging format in addition to the illustrated reciprocating gauge plug. For instance, air plugs, calipers (either air or electric) or other suitable gauging devices can be used to classify parts into the reject and accept categories.

Figure 6:
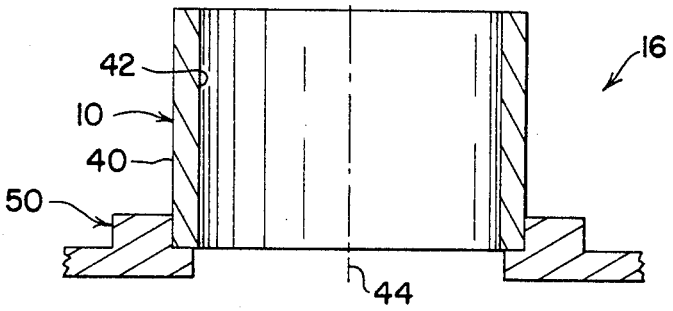
FIG. 6 is a partially sectioned view of the coding magazine for the classified parts.
Figure 6:
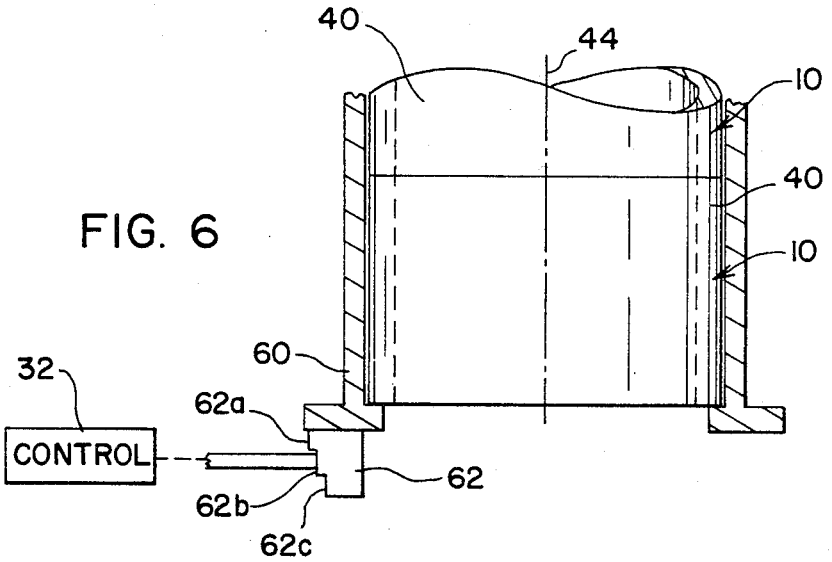

After gauging, the parts in the various acceptable categories are automatically or manually transferred to loading magazines, which in turn can be manually or automatically routed to the heat treating station 30. Thus, as shown in FIG. 6, the broached and gauged parts 10 may be loaded into a tubular magazine 60 in axially aligned relationship. The magazine 60 carries a key or cam 62 having a plurality of cam surfaces 62*a*, 62*b* and 62*c* for establishing the heat treating parameters at the heating station. Depending on the number of classification categories, separate magazines will be provided. As hereinafter explained, the control unit 32 of the heat treating station reads the cam surfaces to control the heat treating cycle parameters.

As each magazine is filled with broached and gauged parts in a particular classification, they are routed to the heat treating station 30. At the heat treating station 30, the cam surfaces 62*a*, 62*b* and 62*c* are read by sensors 63 coupled to the control unit 32.

Figure 7:
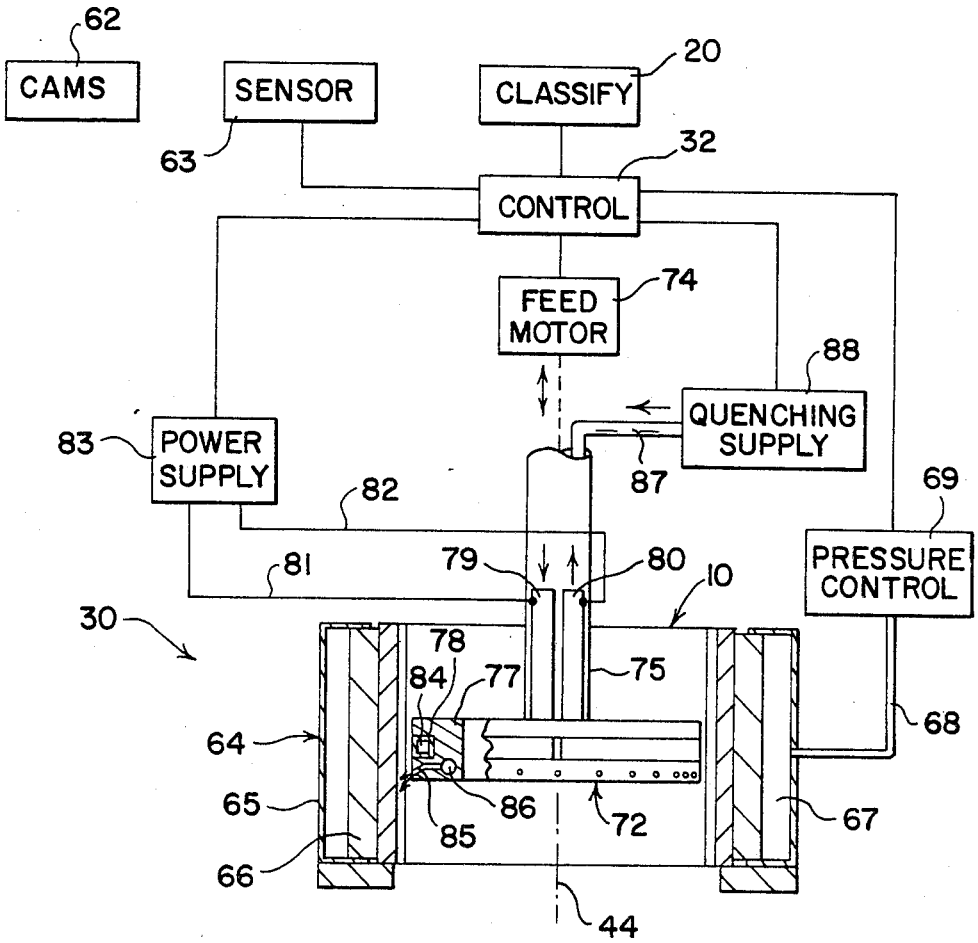
FIG. 7 is a partially sectioned elevational view of the heat treating station together with a control schematic for operation thereof.

Referring to FIG. 7, the heat treating station 30 may be a single station heat treating apparatus or a multiple station heat treating apparatus having individual stations corresponding to the classifications to be processed. However, it will be apparent that regardless of the number of stations, the individual classification parameters will enable each station to process the articles in a custom heat treating mode.

At the heat treating station, the cams 62 of the magazine 60 engage the sensors 63 for establishing the proper process parameters at the control unit 32. The parts 10 are loaded, manually or automatically, into a conventional diaphragm chuck assembly 64. The chuck assembly 64, illustrated somewhat schematically, comprises an outer cylindrical housing 65 and a inner cylindrical platen 66 separated by an annular reservoir 67 fluidly connected by line 68 to a pressure control unit 69. As described in greater detail below upon selective pressurization of the reservoir 67 by the pressure control unit 69, the platen 66 is biased against the outer surface of the part 10 to variably and uniformly clamp the outer cylindrical surface of the part. An inductor 72 mounted on the heat treating station framework, not shown, is operatively connected to a feed motor 74 by means of a shaft 75 for telescopic movement along the axis 44 of the part 10. The inductor 72 comprises a cylindrical carrier 77 which is secured to the shaft 75 and has an outer circumferential groove in which a single loop inductor coil 78 is retained. The coil 78 has axially upwardly extending power leads 79, 80 which are connected by lines 81, 82 to an induction heating power supply 83. The coil 78 is constructed of square copper tubing and has an internal cooling passage 84 fluidly connected to a cooling supply, not shown, for maintaining the temperature of the coil 78 within a predetermined range for efficient heating. During the heating cycle, coolant flows from the cooling supply through the passage 84 in the direction of the arrows. The inductor 72 also contains a circumferential series of radial quenching ports 85 which are fluidly connected by means of internal passage 86 and a coolant line 87 extending upwardly through the shaft 76 to a quenching supply 88. The power supply 83, the feed motor 74, the quenching supply 88 and the pressure control unit 69 are operated selectively by the control unit 32. The control unit 32 through the sensor 63 reads the parameters from the cams 62 and provides operative signals to the parameter control devices at the feed motor 74, the quenching supply 88, the pressure control unit 64 and the power supply 83 to vary the operation thereof in accordance with the classification of the broached part presented to the heat treat station.

The heat treating station beneficially operates in accordance with the scanning heat treating method disclosed in U.S. Pat. No. 4,401,485, particularly if multiple parts are to be heat treated at one time. At the start of the inductive heating cycle, the power supply and the feed motor 74 are energized at the desired level and rate by the control unit 32. This moves the shaft 75 and the inductor 72 downwardly. Alternatively, the part may move with respect to a stationary inductor. With an airgap coupling between the inductor 72 and the interior surface preferably in the range of about 0.030 to 0.050 in., the inductor coil 78 heats the broached surface. When the inductor 72 reaches the lower end of the part 10, a dwell period may be provided. Thereafter, the feed motor 74 is reversed and the inductor 72 moves upwardly continuing to heat the interior surface and uniformly establish the desired heat treating temperature to a desired depth. This is a controlled process parameter as outlined below. During the upward movement, the quenching supply 88 is energized to supply quenching liquid through line 87 and passage 86 radially outwardly through the ports 85 to quench locally and progressively harden the broached surface. During the heat treating cycle, the pressure control unit 69 is regulated to provide a predetermined determined clamping pressure on the exterior of the part. Alternatively, depending on the axial width of the parts, a single part may be inductively heated by a stationary inductor whereby the feed motor may be eliminated and increase the uniformity of heating, the inductor may also be relatively rotated with respect to the part.

At the heat treating station 30, one or more parts may be axially aligned and serially heat treated depending on the capabilities of the particular station. It will also be appreciated that the cycle may be formed in a single pass, rather than a bidirectional pass while providing the controlled heat treating cycle necessary for the sizing and hardening of the parts.

With regard to the interrelationship between the power level of the power supply 83 and the speed of the feed motor 74 versus the part classification, the effective rate of heating is controlled by the control unit 32 to variably transform the unhardened steel into the austenite phase. The amount of austentite formed will be sufficient to provide the necessary hardening under the varying quenching cycles provided. It will also be effective to provide the crystalline growth necessary for establishing the size of the inner configuration to within the parts specifications. The quenching rate from the quenching supply 88 will be sufficient to transform the austenite to martensite and other products to thereby provide the desired hardness and control the metallugical crystalline change thereby effecting the desired diametral changes. The power levels and the quenching rates are interrelated to avoid excessive stresses at the hardened interface which could promote cracking or fracturing.

The pressure applied by the pressure control unit 69 to the reservoir 67 of the diaphragm chuck assembly 64 through line 68 will establish a variable compressive loading on the outer surface and a compressive internal stress within the part 10. This will geometrically restrain the periphery of the part and thereby control the inner and outer diametral changes due to thermal expansion. During the heating cycle the excessive internal stresses will be relieved by yielding at the elevated temperatures and the resultant direction of diametral change will be controlled by the prevailing pressure in the reservoir 67. During quenching the crystalline growth at the inner surface will be controlled by internal yielding in the part with the result that diametral shrinkage due to this effect can be directionally varied as a function of applied pressure at the reservoir 67 and in conjunction with the thermal contraction of the part 10.

While the above invention has been described with reference to the heat treating and sizing of broached internal surfaces, it will be readily apparent that the same is adaptable to other machining processes and may be applied to exterior and curvilinear surfaces by similar control of the heating, the quenching and pressure parameters during the heat treating cycle. The system from the machining through the gauging, classification and heat treating operations may be fully automated. The process is also adaptable for non heat-treated parts having complex configurations requiring dimensional control.

We claim:

1. An apparatus for heat treating thin walled cylindrical parts of a ferrous material to a finished internal diameter and hardness within a product specification comprising:

means for inductively heating the internal surface of the part to form an austenitic structure;

means for quenching the inductively heated surface at a rate establishing said hardness within a product specification and transformation of said austenitic structure to a martensitic structure;

means for compressively loading the external surfaces of the part during said heating and quenching at a level resisting thermal expansion during heating and grain growth of said martensitic structure during said quenching sufficient to establish said finished predetermined internal diameter within a product specification upon cooling of the part to ambient conditions.

2. An apparatus for heat treating ferrous articles having a pre-heat treated dimension comprising:

measuring means for determining said pre-heat treated dimension;

classifying means responsive to said measuring means for classifying said article into one of a plurality of categories;

inductive heating means for heating said article to an elevated temperature sufficient to form an austenitic structure;

quenching means for cooling said article after forming said austenitic structure and forming a martensitic structure tending to effect an increase in said pre-heat treated dimension;

pressure means for pressurizing said article to establish a compressive load resisting said increase in said pre-heat treated dimension during operation of said inductive heating means and said quenching means, said pressure means being responsive to said measuring means to establish a compressive load limiting said increase to a specified post heat treated amount.

3. An apparatus for heat treating hollow cylindrical articles having an inner cylindrical surface to be hardened to a finished diameter comprising:

classifying means for determining the diameter prior to heat treating;

inductive heating means for inductively heating the inner cylindrical surface and a radial thickness therethrough sufficient to establish an austenitic structure therefor;

fluid pressure means for uniformly compressively loading the outer cylindrical surface of the part;

quenching means for applying liquid media onto said cylindrical surface to cool the inductively heated part at a rate transforming said austenic structure to a martensitic structure;

means for energizing said pressure means during said heating and quenching means to establish said compressive loading in a manner influencing diameteral changes during said heating and said transforming such that the post heat treated inner diameter is within a specified predetermined dimensional range.

4. The apparatus as recited in claim 3 wherein said means for classifying establishes a plurality of article categories, identifies one of the categories into which an article is to be classified based on the article presented to said heat treating means, and individually selectively establishes a heating, quenching and pressurizing parameter based thereon for altering the diameter to within said specified dimensional range.

5. The apparatus as recited in claim 4 wherein said heat treating and quenching are controlled in a manner effective to provide selective dimensional alteration through selective grain alteration while attaining said specified surface hardness.

6. The apparatus as recited in claim 4 wherein said classifying establishes acceptable categories and unacceptable categories and said means for energizing interacts only with respect to articles in said acceptable categories.

* * * * *